US005957720A

United States Patent [19]

Boudin

[11] Patent Number: 5,957,720

[45] Date of Patent: Sep. 28, 1999

[54] FEMALE SOCKET OF MODULAR-JACK TYPE WITH INTEGRATED CONNECTIONS

[75] Inventor: Yves Boudin, Creteil, France

[73] Assignee: Pouyet S.A., Yvry Sur Seine, France

[21] Appl. No.: 09/018,890

[22] Filed: Feb. 5, 1998

[30] Foreign Application Priority Data

Feb. 27, 1997 [FR] France ..... 97.02631

[51] Int. Cl.[6] ..... H01R 4/26

[52] U.S. Cl. ..... 439/417; 439/676; 439/409

[58] Field of Search ..... 439/417, 676, 439/409, 467, 402, 344

[56] References Cited

U.S. PATENT DOCUMENTS 4,653,829 3/1987 LaMont ..... 439/409

5,358,430 10/1994 Bonvallat et al. ..... 439/676

5,762,518 6/1998 Tanigawa et al. ..... 439/409

*Primary Examiner*—Paula Bradley

*Assistant Examiner*—Tho D. Ta

*Attorney, Agent, or Firm*—Browdy and Neimark

[57] ABSTRACT

This invention relates to a socket of the "modular-Jack" type, provided to receive cables arriving from very varied directions. It is associated with a connecting pusher which is totally symmetrical with respect to a transverse plane. Jaws fixed on the socket cooperate with shapes on the rear of the pusher in a order to grip it and introduce it by force, with a lever effect, in this receiving part. The receiving part has insulation displacement contact, which are intended to engage strands of the cable received.

4 Claims, 5 Drawing Sheets

FEMALE SOCKET OF MODULAR-JACK TYPE WITH INTEGRATED CONNECTIONS

FIELD OF THE INVENTION

The present invention relates to a female socket of the "Modular-Jack" type, typically a socket receiving telephone or computer-related lines contained in an input cable, and into which the user will plug a complementary male socket of the "Modular-Jack" type, for his/her telephone or computer needs for example.

BACKGROUND OF THE INVENTION

The difficulty with known sockets resides in the fact that they do not take into account the imperatives of radius of curvature of the input cable which is connected to the rear of the socket.

In order to clarify the specification, accompanying FIG. 1 shows all the existing possibilities for routing the input cable on a socket 1 of known type. This socket 1 may be supplied by a cable which is routed either in projecting tubings 2, 3 whence it can arrive from the right or from the left, or from the rear in flush-mounted tubings 4, 5, or from above in a column 6, or from below in a bracket 6A.

No risks should be taken, at the point of connection of the cable on the rear of the socket 1, of breaking this cable or at least of tearing its screen. To that end, a standard exists, whereby the radius of curvature given to the cable in a bend must never be less than 8 times the outer diameter of this cable.

In addition, the depth of the routing tubing should be taken into account. For a conventional tubing with a depth of 40 mm, the radius of curvature of the cable can, finally, not be less than 30 mm.

Of course, the wires emerging from the end of the cable may be bent and connected to the so-called I.D.C.'s, or insulation displacement contacts, which are found, generally aligned in two parallel rows, at the rear of the socket. Although it is acceptable to bend these wires at 90 degrees, it is, on the contrary, inacceptable to bend them to more than 90 degrees, and therefore even less so to 180 degrees.

It follows that, with these known devices, it is impossible to connect socket 1 cables arriving in diametrally opposite directions, with the result that the installation must finally be adapted accordingly, this considerably restricting the latitude of concept of such an installation.

It is an object of the invention to overcome this drawback.

SUMMARY OF THE INVENTION

To that end, it relates to a female socket of the "Modular-Jack" type, whose rear part is fitted with I.D.C.'s, or insulation displacement contacts, all directed in the same direction and each adapted to receive one of the strands of line contained in an input cable, a separate termination pusher being provided to receive each of these strands and then to plug in the rear of the socket, in that case pushing each strand in its respective I.D.C. In this plugging movement, the socket is equipped with two jaws for receiving a termination pusher, these two jaws being arranged so that, in their movement of closure, they grip the rear of the pusher, shaped accordingly, and progressively bring it closer, by the lever effect, to its position of complete plug-in on the rear of the socket.

The termination pusher presents a totally symmetrical shape, allowing it to receive these strands of line either from one side or the other and parallel to the common plane of the free end branches of the two jaws when they are in the state of closure.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
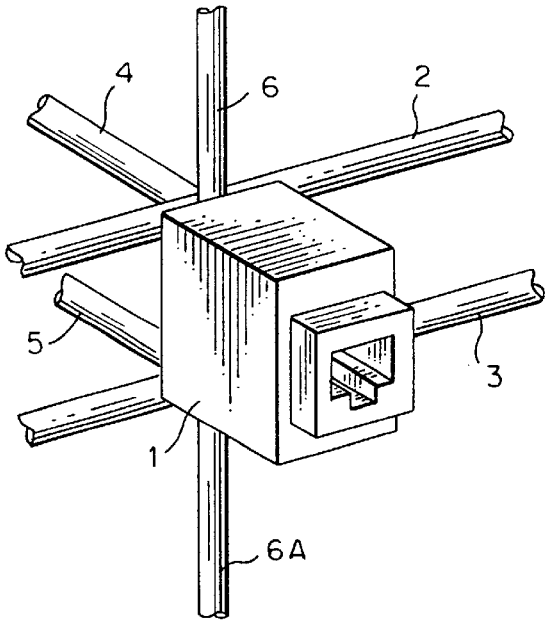
FIG. 1 (PRIOR ART)
FIG. 1 shows a perspective view of a conventional modular jack.
Figure 2:
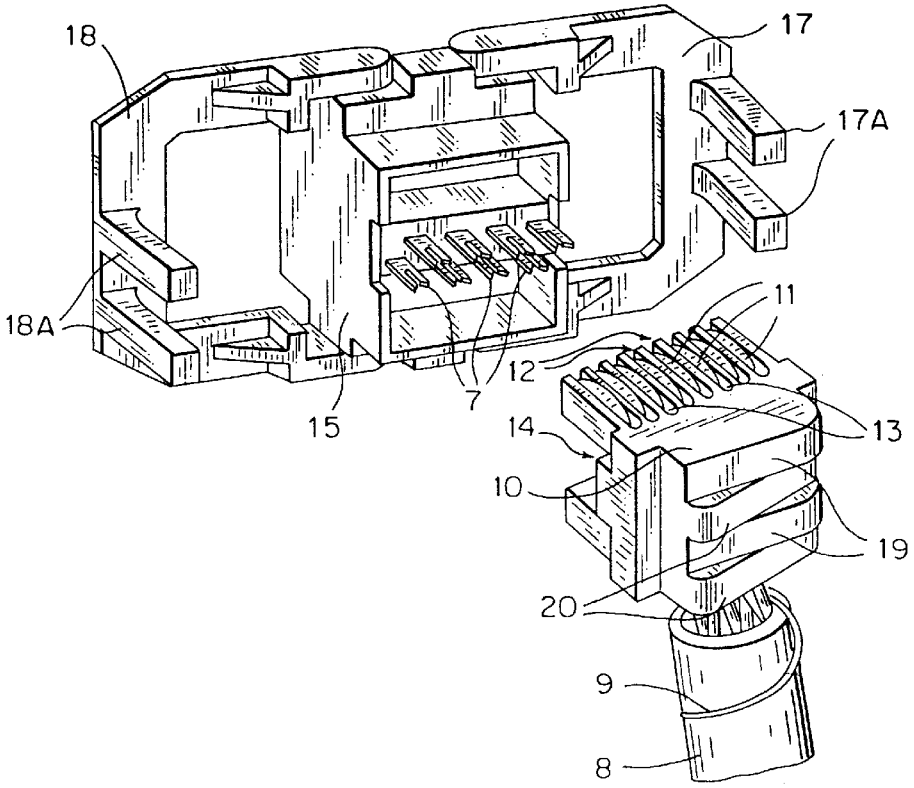
FIG. 2 is a view in perspective of the rear of the socket, jaws open and termination pusher separate but already equipped with the strands of line of the input cable.
Figure 4:
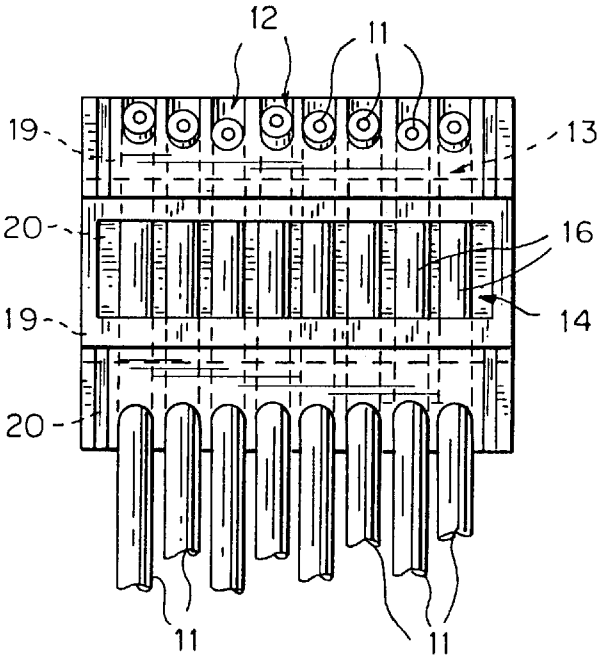
FIG. 4 is a view in the direction F of FIG. 3.
Figure 3:
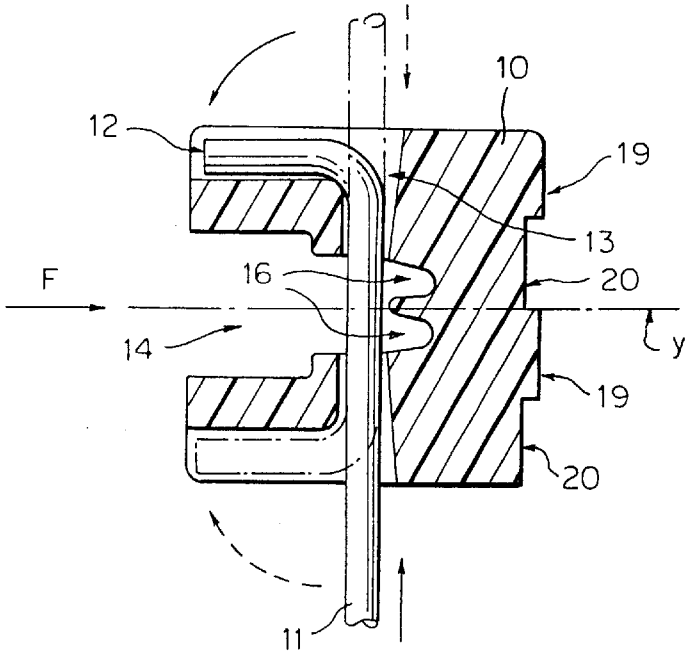
FIG. 3 is a longitudinal section of the termination pusher of FIG. 2, showing the positioning of a strand of line.

Referring again to the drawings, and now to all of FIGS. 2 to 4, the rear part of this telephone or computer-related socket is conventionally equipped with two parallel rows, each of four insulation displacement contacts 7, also known in internationally adopted language as I.D.C.'s.

As illustrated, these eight I.D.C.'s 7 are all flat and oriented in the same direction, parallel to the axis of the socket and towards the rear thereof. Each of these I.D.C.'s 7 is intended to receive one of the strands of a four-pair cable 8 which is to be connected to this socket. In the case of the Figure shown here, this cable 8 arrives from below, in a bracket (not shown). Reference 9 designates its conventional earth wire, or drain.

Reference 10 designates a termination pusher which can be separated from the socket and intended to receive all the strands 11 of cable 8 before this pusher is plugged on the rear of the socket, in that case driving each strand 11 in the respective insulation displacement slot of the I.D.C. 7 associated therewith. This termination pusher is very particular, in that it is totally symmetrical with respect to its median transverse plane Y (see FIG. 3), with the result that each of the strands 11 can all be introduced equally well from above or from below;.

Each strand 11 is introduced in an individual receiving through tubing 13 which passes through the pusher 10 at right angles to the plane Y, then is bent at right angles into a longitudinal receiving tubing 12 which is parallel to plane Y; this configuration being totally symmetrical with respect to plane Y. Thus, the strands 11 may be introduced in the same way from above, as indicated in broken lines in FIG. 3.

The pusher 10 presents an open mouth 14, at the bottom of which the eight strands 11 are visible. This front mouth 14 is intended to be plugged on a complementary male part 15 (FIG. 2) located to the rear of the socket, and which bears the eight I.D.C.'s 7.

Transverse tubings 16 are provided, at the bottom of mouth 14 and to the rear of the through tubing 13, to receive the free ends of the I.D.C.'s, while the strands 11 are driven by force in their respective receiving insulation displacement slots.

The socket comprises two L-jaws 17 and 18 which, on closing on each other, are intended to grip the rear of the pusher 10 which presents receiving shapes 19 and 20 respectively, adapted thereto, provided to cooperate with these jaws in order, by a powerful lever effect which will be shown hereinafter, to plug the pusher 10 by force on its receiving part 15, and therefore to effect connection of the strands 11 on their respective I.C.D.'s 7.

Figure 5:
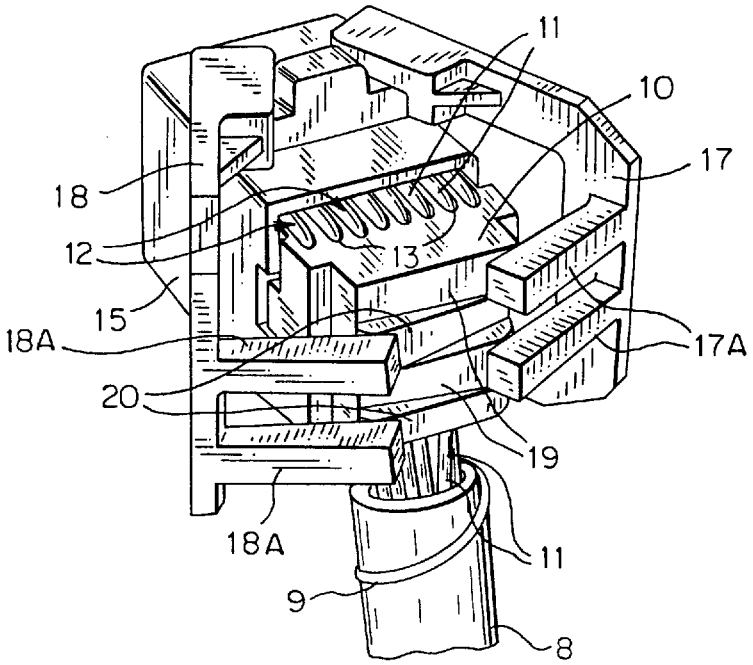
FIG. 5 is a view in perspective, with the jaws in the process of closing on the rear of the termination pusher.
Figure 6:
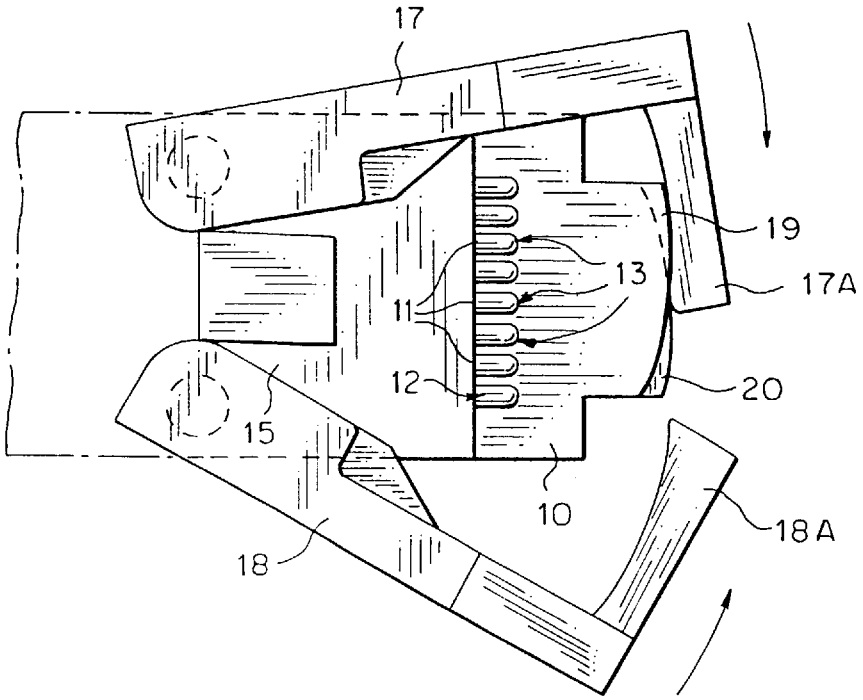
FIG. 6 is a plan view corresponding to the position of FIG. 5.

FIGS. 5 and 6 show the two jaws 17, 18 in the process of closing. By their end branches 17A and 18A, they push on the respective adapted shapes 19 and 20 of the rear of the pusher 10. To that end, it suffices to press laterally on these branches between the thumb and index finger of one hand.

Figure 7:
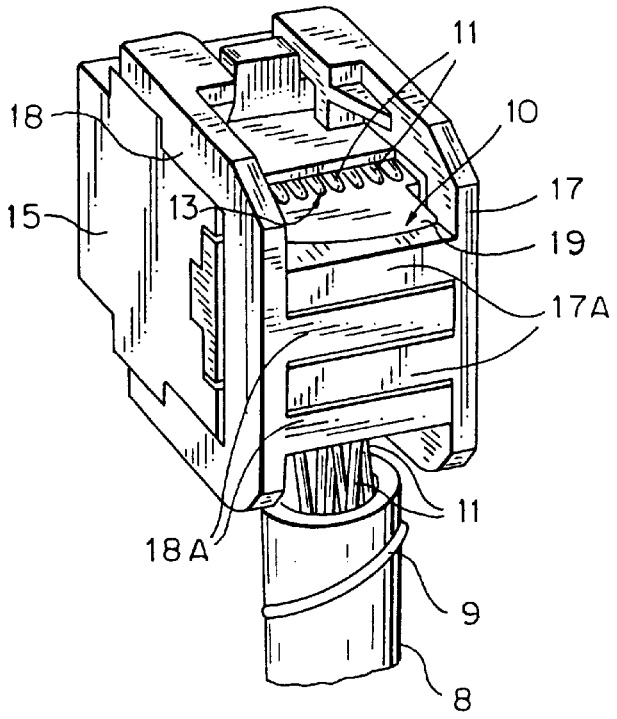
FIGS. 7 and 8 are views respectively similar to FIGS. 5 and 6, with the jaws totally closed and therefore the termination pusher at the end of stroke.
Figure 8:
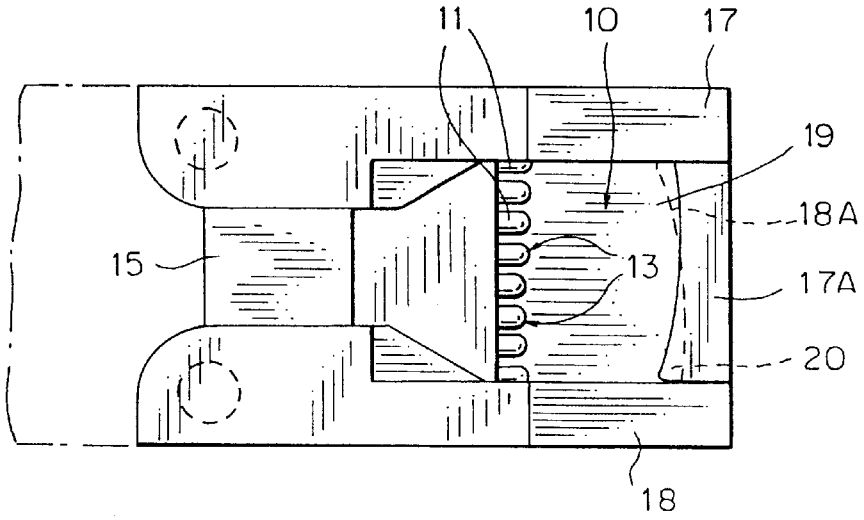
Figure 9:
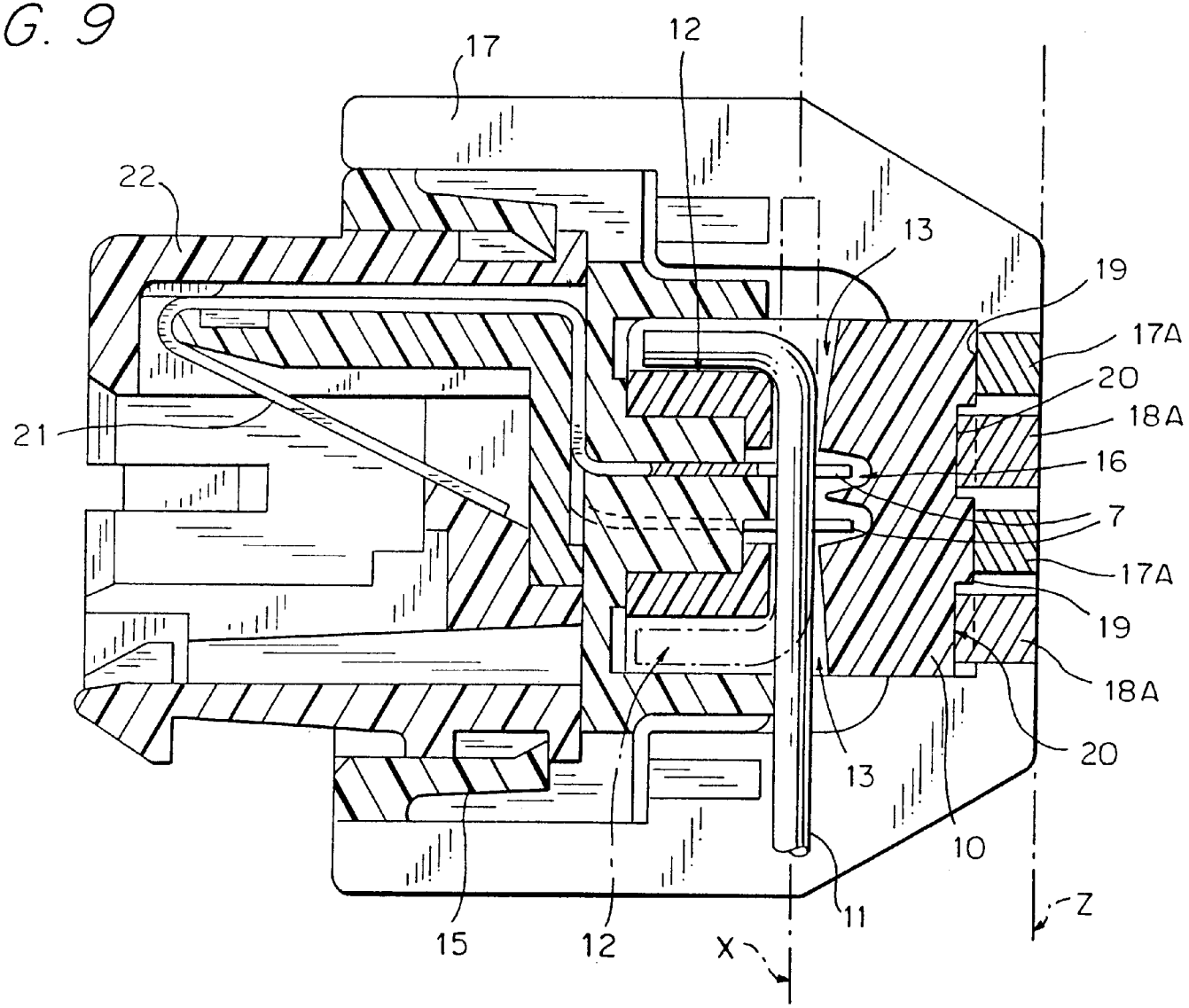
FIG. 9 is a partial longitudinal section of the socket with the jaws in position of complete closure, according to FIG. 7.

At the end of stroke, the termination pusher is totally plugged in and the strands 11 are all introduced in their respective I.D.C.'s 7, as shown in FIGS. 7 to 9, the connection in that case being effected.

It should be noted that the through tubes 13 for receiving the strands of line 11 are located in a plane X which is parallel to the common plane Z of the free end branches (17A, 18A) of the two jaws 17, 18, when the latter are in the state of closure according to FIG. 9.

As shown in FIG. 9, each I.D.C. 7 is conventionally connected, in the body of the socket, to a respective elastic contact 21 of the open mouth 22 of the modular-Jack socket.

The socket described makes it possible to receive, without bending the strands 11, a cable 8 arriving from either below and from above. It may also receive, without problem, a cable 8 arriving either laterally or from the rear, but in that case the strands 11 will have to be bent at right angles, which is acceptable as mentioned hereinabove.

The invention is not limited to the embodiment which has just been described. For example, each jaw 17, 18 might comprise one end branch 17A, 18A instead of two, as appears in the Figures. This socket might also be constructed to receive a number of telephone or computer lines different from four.

What is claimed is:

1. A female socket of the "modular-Jack" type comprising, insulation displacement contacts engaged in a rear part of said socket;

each of said insulation displacement contacts having a longitudinal axis parallel to each other and to a longitudinal axis of the socket;

a free end of each said insulation displacement contacts adapted to engage at least one strand of an input cable;

a separate connecting pusher being provided to engage each said strand of said input cable when partially pushed into the rear part, to engage in a corresponding free end of each of said insulation displacement contacts;

said socket having two jaws rotatable on said socket around said rear part after said connecting pusher has been partially pushed into said rear part, said two jaws gripping corresponding rear surfaces of said connecting pusher and progressively pushing said connector pusher completely into said rear part when said two jaws are rotated to electrically engage each said strand to the corresponding free end of each of said insulation displacement contacts;

each of said two jaws having at least one free end branch, each said free end branch lying in a first common plane perpendicular to the longitudinal axis of each of said insulation displacement contacts when said two jaws have been rotated to push said connecting pusher completely into said rear part;

said connecting pusher having a symmetrical shape which positions each said strand of said input cable in a second common plane parallel to said first common plane and permits engagement of each said strand to the connecting pusher through either of opposite ends of the connecting pusher.

2. The socket according to claim 1, wherein said two jars (17, 18) are L-jaws.

3. The socket according to claim 1, wherein the connecting pusher comprises, symmetrically with respect to a horizontal median plane perpendicular to a longitudinal median plane, crossing grooves each receiving a corresponding strand of the input cable, a first portion of said grooves being at right angles to said median horizontal plane, and a second portion of said grooves extending, at right angles parallel to said median horizontal plane, said first portion of said grooves being visible inside a front mouth of said connecting pusher.

4. The socket according to claim 1, wherein an outer periphery of the connecting pusher corresponds to an inner periphery of said rear part.

* * * * *